US008684489B2

(12) United States Patent
Levy et al.

(10) Patent No.: US 8,684,489 B2
(45) Date of Patent: Apr. 1, 2014

(54) SYSTEM AND METHOD FOR FACILITATING CUTTING OF MEDIA HAVING A PHASE CHANGE INK IMAGE

(75) Inventors: Michael J. Levy, Webster, NY (US); Mojgan Rabbini, Pittsford, NY (US); David A. Mantell, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 945 days.

(21) Appl. No.: 12/247,856

(22) Filed: Oct. 8, 2008

(65) Prior Publication Data

US 2010/0086339 A1 Apr. 8, 2010

(51) Int. Cl.
*B41J 29/38* (2006.01)
*B41J 2/01* (2006.01)

(52) U.S. Cl.
USPC ..... 347/17; 347/16; 347/101; 347/104

(58) Field of Classification Search
USPC ..... 347/16, 17, 101, 104
See application file for complete search history.

(56) References Cited

U.S. PATENT DOCUMENTS 4,653,362 A * 3/1987 Gerber ..... 83/16
4,679,474 A * 7/1987 Lambrecht ..... 83/171
5,349,890 A 9/1994 Butkus et al.
5,379,962 A 1/1995 Albrecht et al.
5,751,303 A * 5/1998 Erickson et al. ..... 347/16
5,810,279 A 9/1998 Rodriguez et al.
2003/0189628 A1* 10/2003 Kaga et al. ..... 347/102
2005/0074260 A1 4/2005 King et al.
2005/0140767 A1* 6/2005 Kaga et al. ..... 347/104
2005/0285917 A1* 12/2005 Nichols et al. ..... 347/90
2006/0007292 A1* 1/2006 Ohmori et al. ..... 347/104
2006/0180273 A1 8/2006 Beck
2007/0221024 A1* 9/2007 Negishi et al. ..... 83/170
2008/0106025 A1 5/2008 Padros et al.
2008/0159800 A1* 7/2008 Wada ..... 400/621

FOREIGN PATENT DOCUMENTS

JP 2006167967 A * 6/2006

OTHER PUBLICATIONS

European Search Report corresponding to European Patent Application 09172424.5, European Patent Office, Munich Germany, Oct. 20, 2010 (7 pages).

* cited by examiner

*Primary Examiner* — Alessandro Amari
*Assistant Examiner* — Kendrick Liu
(74) *Attorney, Agent, or Firm* — Maginot, Moore & Beck, LLP

(57) ABSTRACT

A system cuts media printed with phase change ink in a manner that reduces the ink debris produced by cutting solidified ink. The system includes a heater configured to heat phase change ink on the media moving through the heater to a temperature at which the ink is malleable, the temperature being above room temperature and below a temperature at which phase change ink melts, and a cutter configured to receive the media after the media has been heated by the heater and to cut the media. The blade of the cutter may also be heated to facilitate media cutting with a reduced likelihood of solid ink debris being generated.

13 Claims, 2 Drawing Sheets

SYSTEM AND METHOD FOR FACILITATING CUTTING OF MEDIA HAVING A PHASE CHANGE INK IMAGE

TECHNICAL FIELD

This disclosure relates generally to phase change ink imaging devices, and, in particular, to systems for cutting media in phase change ink imaging devices.

BACKGROUND

In general, ink jet printing machines or printers include at least one printhead that ejects drops or jets of liquid ink onto a recording or image forming media. A phase change ink jet printer employs phase change inks that are solid at typical room temperatures, but melt to become a liquid at elevated temperatures. The melted ink can then be ejected by a printhead directly onto an image receiving substrate, or onto an intermediate imaging member for transfer to an image receiving substrate. Once the ejected ink is on the image receiving substrate, the ink droplets quickly solidify to form an image.

In some phase change ink imaging devices, the image receiving substrates are individual sheets of recording media. The sheets are typically stored in one or more supply trays and retrieved, one at a time, for image processing. This type of printer is very effective for customized image renderings and document production. In other phase change ink imaging devices, the image receiving substrate is a web of recording media that is continuously fed into the printer on a path that transports the media past the printheads for reception of an image and then transported to an output area. In some web printers, the web is rewound onto a take-up roll. When the entire web has been imaged, the take-up roll is removed and taken elsewhere for further processing. In other web printers, the web is cut into individual sheets that are ejected into a collection bin.

Webs printed by phase change ink printers receive more than the images that are rendered for production. In addition to the ink images, the printer controller ejects ink in images or patterns outside of an image area on the web. In some cases, this extra area includes part of the image that is cut off because the printed image goes up to the edge of the cut sheet. These patterns may also include test patches for evaluating colors being generated by the printheads, fiducials for alignment verification, and other non-document image patterns. In the printers in which the printed media is cut at the end of the printing process, these non-document image patterns may present issues. If the patterns are positioned in the inter-document areas between document images, the cutter may have to cleave the solidified ink in the non-document image patterns. Because melted phase change ink solidifies rather quickly after being ejected, it does not bleed into the media. This property enables images formed on the print media with phase change ink to exhibit bright, vibrant colors. Cutting this solidified ink, however, may cause the solidified ink to break or flake off the media. Reducing the debris arising from the ink fragments is a worthwhile goal in solid ink printers.

SUMMARY

A system cuts media printed with phase change ink in a manner that reduces the ink debris produced by cutting through areas printed with phase change ink. The system includes a heater configured to heat phase change ink on media moving through the heater to a temperature at which the ink is malleable, the temperature being above room temperature and below a temperature at which phase change ink melts, and a cutter configured to receive the media after the media has been heated by the heater and to cut the media.

The system may be used to implement a method for cutting a web printed with phase change ink to reduce the amount of ink debris produced by cutting the web. The method includes heating phase change ink on a web to a temperature that is above room temperature and below a temperature at which phase change ink melts, the heating of the phase change ink occurring proximate to a cutter, and cutting the web into sheets with the cutter.

The system and method may be incorporated in a phase change ink imaging device. The device includes a print station configured to deposit melted phase change ink on a moving web, the melted phase change ink being configured to solidify after being deposited on the print substrate, a heater configured to heat the solidified phase change ink on a web moving through the heater to a temperature at which the phase change ink is malleable, the temperature being above room temperature and below a temperature at which phase change ink melts, and a cutter configured to receive the web after the phase change ink has been heated by the heater and to cut the web into sheets.

BRIEF DESCRIPTION OF THE DRAWINGS

The foregoing aspects and other features of the system and method that soften solidified phase change ink for media cutting are explained in the following description, taken in connection with the accompanying drawings.

DETAILED DESCRIPTION

Figure 1:
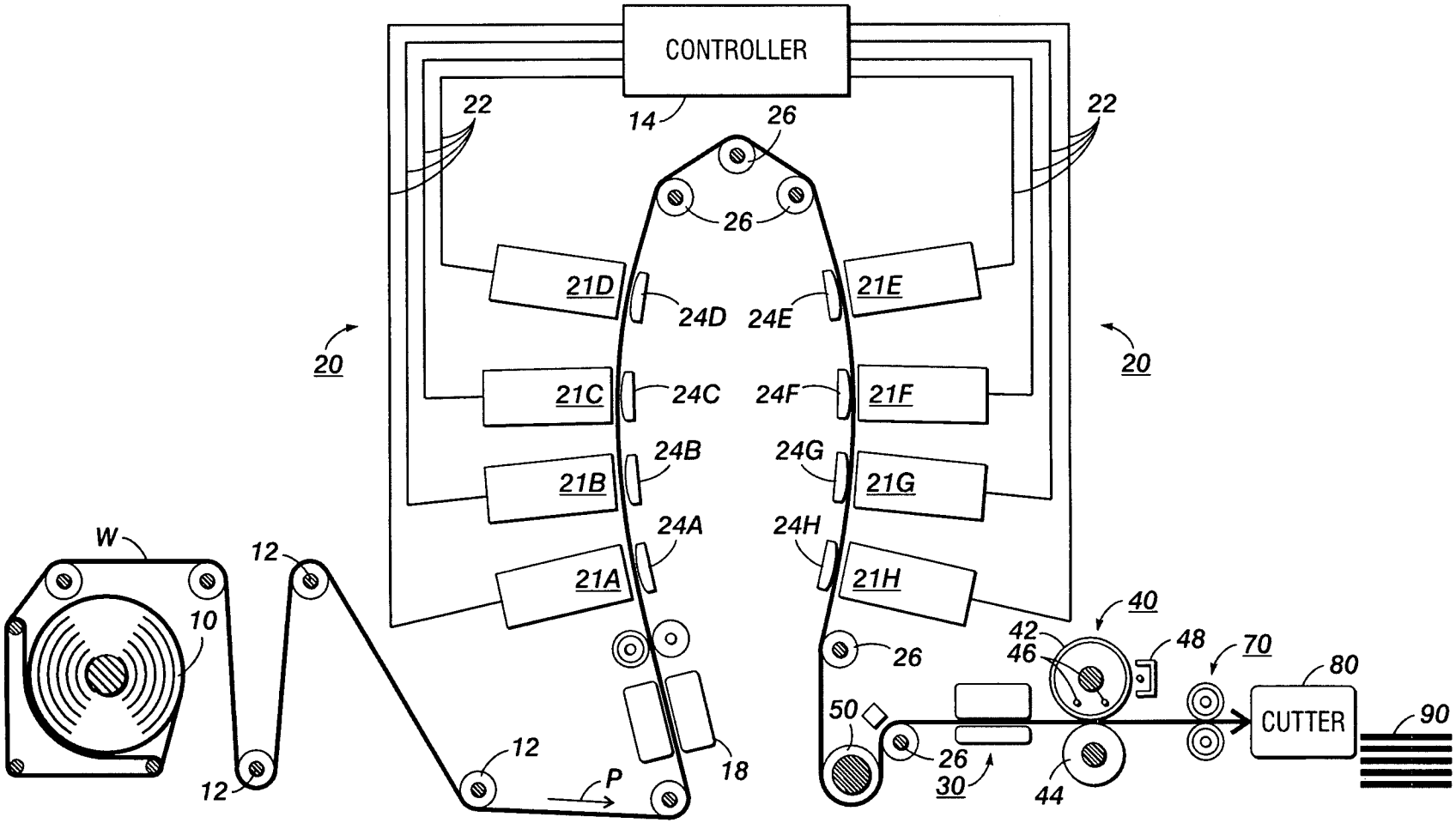
FIG. 1 is a simplified elevational view of a direct-to-sheet, continuous-web, phase-change ink printer.

For a general understanding of the present embodiments, reference is made to the drawings. In the drawings, like reference numerals have been used throughout to designate like elements. FIG. 1 is a simplified elevational view of a direct-to-sheet, continuous-web, phase-change ink printer. A web supply and handling system is configured to supply a very long (i.e., substantially continuous) web W of "substrate" (paper, plastic, or other printable material) from a spool 10. The web W may be unwound as needed, and propelled by a variety of motors, not shown. The web supply and handling system is capable of transporting the web W at a plurality of different speeds. In one embodiment, the web is capable of being moved at any speed between approximately 0 inches per second (ips) and approximately 150 ips. A set of rolls 12 controls the tension of the unwinding web as the web moves through a path.

Prior to entering a printing station 20, a preheater 18 brings the web to an initial predetermined temperature. The preheater 18 can rely on contact, radiant, conductive, or convective heat to bring the web W to a target preheat temperature, which in one practical embodiment, is in a range of about 30° C. to about 70° C. In the printing station 20, the web W moves past a series of printheads 21A-21H. Each printhead effectively extends across the width of the web and is able to place ink of one primary color directly (i.e., without use of an intermediate or offset member) onto the moving web. Eight printheads are shown in FIG. 1, although more or fewer printheads may be used. As is generally familiar, each of the four primary-color images placed on overlapping areas on the web W combine to form color images, based on the image data sent to each printhead through image data paths 22 from print controller 14. In various possible embodiments, there may be provided multiple printheads for each primary color; the printheads can each be formed into a single linear array. The function of each color printhead can be divided among multiple distinct printheads located at different locations along the process direction; or the printheads or portions thereof can be mounted movably in a direction transverse to the process direction P, such as for spot-color applications.

The ink directed to web W in this embodiment is a "phase-change ink," by which is meant that the ink is substantially solid at room temperature and substantially liquid when initially jetted onto the web W. Currently, common phase change inks are typically heated to a temperature in a range of about 100° C. to about 140° C. to melt the solid ink for jetting onto the web W. Generally speaking, the liquid ink cools down quickly upon hitting the web W.

Associated with each printhead is a backing member 24A-24H, typically in the form of a bar or roll, which is arranged substantially opposite the printhead on the other side of web W. Each backing member is used to position the web W so that the gap between the printhead and the sheet stays at a known, constant distance. Each backing member can be controlled to ensure the adjacent portion of the web to remain at a predetermined "ink-receiving" temperature, in one practical embodiment, of about 40° C. to about 70° C. In various possible embodiments, each backing member can include heating elements, cavities for the flow of liquids and the like. Alternatively, the "member" can be in the form of a flow of air or other gas against or near a portion of the web W. The combined actions of preheater 18 plus backing members 24 held to a particular target temperature effectively maintains the web W in the printing zone within station 20 in a predetermined temperature range of about 40° C. to 70° C. The tension rollers 26 maintain the web at an appropriate tension for printing as the web passes through the printing station 20.

As the partially-imaged web moves to receive inks of various colors throughout the printing station 20, the temperature of the web is maintained within a given range. Ink is jetted at a temperature typically significantly higher than the receiving web's temperature, which heats the surrounding paper (or whatever substance the web W is made of). Therefore, the members in contact with or near the web in the zone in station 20 must be adjusted so that that the desired web temperature is maintained. For example, although the backing members may have an effect on the web temperature, the air temperature and air flow rate behind and in front of the web may also impact the web temperature. Accordingly, air blowers or fans may be utilized to facilitate control of the web temperature.

The web temperature is kept substantially uniform for the jetting of all inks from printheads in the printing zone 20. This uniformity is valuable for maintaining image quality, and particularly valuable for maintaining constant ink lateral spread (i.e., across the width of web W, such as perpendicular to process direction P) and constant ink penetration of the web. Depending on the thermal properties of the particular inks and the web, this web temperature uniformity may be achieved by preheating the web and using uncontrolled backer members, and/or by controlling the different backer members 24A-24H to different temperatures to keep the substrate temperature substantially constant throughout the printing station. Temperature sensors (not shown) are positioned to measure web temperatures may be used with a control system to regulate the temperature of the web in the printing station 20, as well as systems for measuring or inferring (from the image data, for example) how much ink of a given primary color from a printhead is being applied to the web W at a given time. The various backer members can be controlled individually, using input data from the printhead adjacent thereto, as well as from other printheads in the printing station.

After traveling through the printing station 20, the web W reaches a "spreader" 40. The function of the spreader 40 is to take what may be isolated droplets of ink on web W and smear them so that spaces between adjacent drops are filled and image solids become uniform. The spreader is configured to use pressure to perform the spreading operation. In one embodiment, heat may also be used to aid in spreading. In addition to spreading the ink, the spreader 40 may also improve image permanence by increasing ink layer cohesion and/or increasing the ink-web adhesion. The spreader 40 includes rolls, such as image-side roll 42 and pressure roll 44. These rollers apply heat and pressure to the web W. Either one or both of the rolls can include heat elements 46 to bring the web W to a temperature in a range from about 35° C. to about 80° C. In one practical embodiment, the roll temperature in spreader 40 is maintained at about 55° C.

Once melted phase change ink has been deposited and spread on a recording medium, the recording medium may be cut into sheets. In FIG. 1, the web is tensioned by tension rollers 70 before it enters a cutter 80 where a knife severs the web into sheets that are deposited into an output tray 90. In one embodiment, the cutter 80 may be a Pitney-Bowes Cutter/Stacker RSI-2UP. As noted above, cutting the web W along lines that sever solidified ink may cause some of the ink to break or flake off the web. To reduce or prevent the solidified phase change ink on the web from breaking or flaking off during cutting of the print media, a heater is positioned immediately prior or internal to cutter 80 to heat the ink. Heating the phase change ink prior to cutting the media softens the phase change ink. The softened ink moves instead of breaking or flaking during cutting. Consequently, much less ink debris is produced and collected in the cutter 80.

The heater preceding the cutter is configured to apply thermal energy to the phase change ink and the web W in order to heat the ink to a temperature that is greater than room temperature, but less than the melting temperature of the phase change ink. In one embodiment, the temperature is any temperature in a range from about 50° C. to about 120° C. The ability of the heater to prevent or reduce ink breaking and flaking during cutting increases with the magnitude of the temperature up to a temperature where the ink becomes liquid again and may bleed into the recording media, if porous. Consequently, an upper temperature is selected for the range that is below the temperature at which the solidified ink again becomes liquid.

Figure 2:
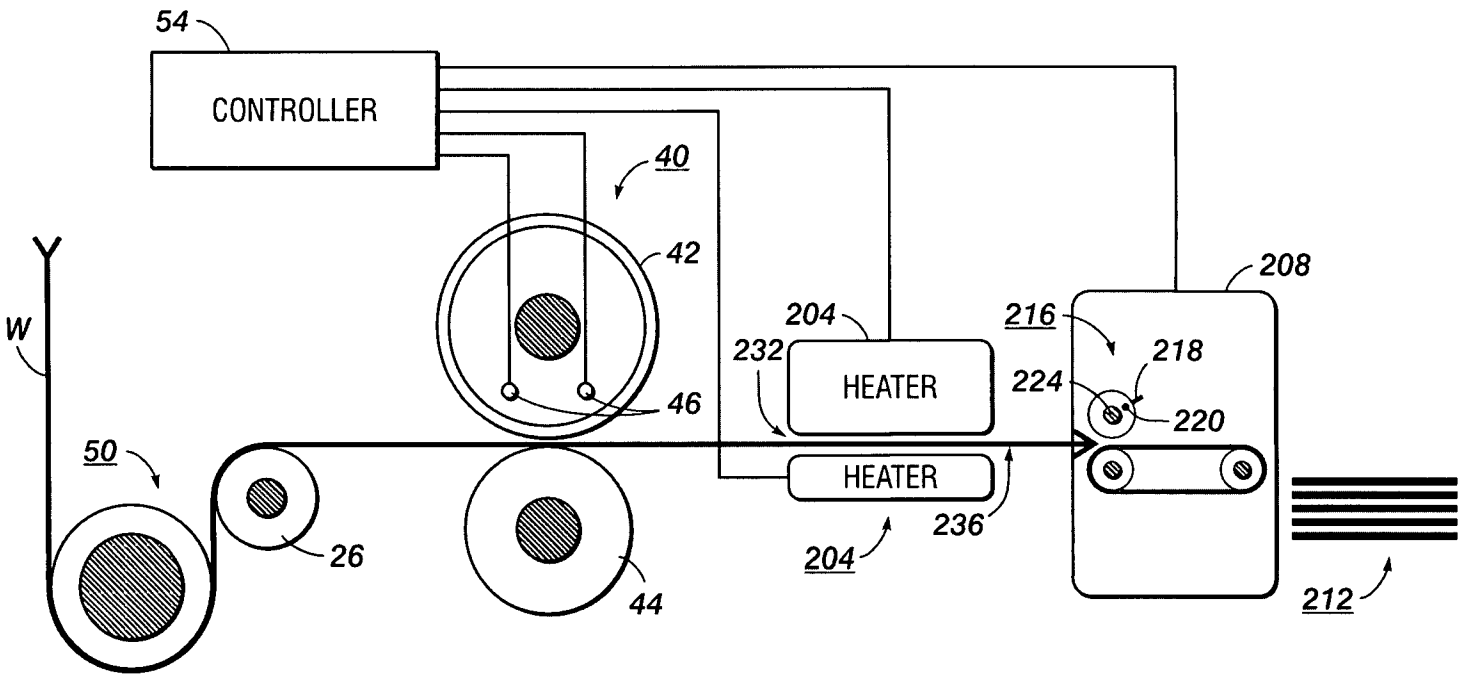
FIG. 2 is a block diagram of an embodiment of an ink heater and web cutter that may be implemented in the phase change ink imaging device of FIG. 1.

FIG. 2 is a block diagram of a heating and cutting system that may be implemented in the phase change ink printer of FIG. 1. The system 200 includes an ink heater 204 and a cutter 208. The heater 204 and cutter 208 are arranged to receive the web W after it has been processed by the spreader 40. The cutter 208 ejects cut sheets into an output tray 212. The cutter 208 includes a knife 216. Knife 216 may be one or more blades 218 on a rotating cylinder 220, although the knife 216 may also be implemented with a blade mounted on a reciprocating member. Alternatively or additionally, the cutter 208 may also include a heating element that heats the blade to a temperature that helps maintain the ink in the range described above to keep the ink malleable. The heating element may provide radiant, convective, conductive, or inductive heat to the blade or blades 218. For example, the blade 218 may be formed with a thermally conductive material, such as aluminum, and be provided with an internal heater such as resistance heating wires or traces disposed within the blade that are configured to heat the blade to a temperature in the range of about 50 degrees C. to about 100 degrees C. The blade may also be heated by external heaters or a combination of internal and external heaters. In an implementation in which the blades 218 are mounted to a cylinder 220, a cartridge heater 224 may be mounted with the rotating cylinder to heat the cylinder and the knife. In another embodiment, the heater may be configured or controlled to heat the ink sufficiently to approach the softening temperature and the blade may be heated to a temperature that sufficiently heats the softened ink as it cuts the ink that little or no ink debris is produced. In such an embodiment, the heater may heat the ink to any temperature in a range of about 40 to about 50 degrees C. and the blade may be heated to any temperature in the range of about 50 to about 100 degrees C.

In a similar manner, the heat generated by the heater 204 may be regulated by the controller to heat the solidified ink on the web W to a temperature in the above-described range using convective, radiant, or conductive heat. The heater 204 may, for example, include a thermally insulated and heated housing. The housing is formed of a plurality of walls made of any suitable thermally insulated material, such as plastic. The housing includes an inlet opening 232 to receive the web W and an outlet opening 236 that is positioned proximate to the cutter 208 so the temperature on the web does not drop below the range in which the ink is malleable as the ink is being cut. Heating elements in the heater 204 are coupled to the controller 54 for selective activation of the heating elements to heat the air within the housing. Any suitable number and type of heating elements may be used to heat the air within the housing uniformly to a degree that brings the ink on the web W to a temperature in the desired temperature range. For example, heating elements for heating the air inside the housing may comprise one or more radiant heaters.

The controller 54 is configured to receive temperature readings from one or more temperature sensors (not shown) to determine a temperature for the phase change ink on the moving web. The controller then selectively generates signals for coupling the heating elements in the heater 204 and the cutter 208 to an electrical source for the generation of heat. The controller 54 may be a general purpose microprocessor that executes programmed instructions that are stored in a memory. The controller also includes the interface and input/output (I/O) components for receiving temperature readings from sensors and status signals from the printer and for supplying control signals to the printer components. Alternatively, the controller may be a dedicated processor on a substrate with the necessary memory, interface, and I/O components also provided on the substrate. Such devices are sometimes known as application specific integrated circuits (ASIC). The controller may also be implemented with appropriately configured discrete electronic components or primarily as a computer program or as a combination of appropriately configured hardware and software components. The programmed instructions stored in the memory of the controller also configure the controller to implement the process described above for regulating the heat generated by the heater 204 and the temperature of the blade or blades within the cutter 208.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A system for cutting media printed with phase change ink comprising:

a heater configured to heat phase change ink on the media moving through the heater to a temperature at which the ink is malleable, the temperature being above room temperature and below a temperature at which phase change ink melts; and a cutter configured to receive the media after the ink has been heated by the heater to the temperature at which the ink is malleable and to cut the media, the cutter including a blade that is heated to a temperature that is above room temperature and below a temperature at which phase change ink melts.

2. The system of claim 1 wherein the media is a web.

3. The system of claim 1 wherein the media is paper.

4. The system of claim 1 wherein the temperature to which the ink is heated is in a range of about 50 degrees C. to about 100 degrees C.

5. The system of claim 1 wherein the blade is heated to a temperature in a range of about 50 degrees C. to about 100 degrees C.

6. The system of claim 1 wherein the blade is coupled to a rotating cylinder.

7. The system of claim 1, the heater further comprising:

a thermally insulated and heated housing through which the web moves; and at least one heater for heating air within the housing to a temperature that brings the phase change ink on the media moving through the housing to the temperature greater than room temperature and less than the temperature at which phase change ink melts.

8. The system of claim 7 wherein the at least one heater heats the air within the housing to a temperature that brings the phase change ink on the web moving through the housing to a temperature in a range of about 50 degrees C. to about 100 degrees C.

9. A method of cutting a media printed with phase change ink comprising:

heating phase change ink on a media to a temperature that is above room temperature and below a temperature at which phase change ink melts, the heating of the phase change ink occurring proximate to a cutter;

selectively activating resistive tracings on a blade in the cutter to heat a blade in the cutter to a temperature that is above room temperature and below a temperature at which phase change ink melts; and cutting the media into sheets with the blade in the cutter.

10. The method of claim 9 wherein the temperature to which the phase change ink is heated is in a range of about 50 degrees C. to about 100 degrees C.

11. The method of claim 9 wherein the blade is heated to a temperature in a range of about 50 degrees C. to about 100 degrees C.

12. The method of claim 9, the heating of the phase change ink further comprising:

heating air within a housing through which the media moves to a temperature that brings the phase change ink on the media moving through the housing to the temperature greater than room temperature and less than the temperature at which phase change ink melts.

13. The method of claim 12 wherein the heating of the air within the housing brings the phase change ink on the web moving through the housing to a temperature in a range of about 50 degrees C. to about 100 degrees C.

* * * * *

UNITED STATES PATENT AND TRADEMARK OFFICE

CERTIFICATE OF CORRECTION

PATENT NO. : 8,684,489 B2
APPLICATION NO. : 12/247856
DATED : April 1, 2014
INVENTOR(S) : Levy et al.

It is certified that error appears in the above-identified patent and that said Letters Patent is hereby corrected as shown below:

Title Page: (75) Inventors: Replace "Mojgan Rabbini" with --Mojgan Rabbani--

Signed and Sealed this
Tenth Day of June, 2014

Michelle K. Lee

Michelle K. Lee
*Deputy Director of the United States Patent and Trademark Office*